United States Patent [19]

Lotz et al.

[11] Patent Number: 4,690,753

[45] Date of Patent: Sep. 1, 1987

[54] COAL PROCESSING SETTLING MACHINE

[75] Inventors: Alexander Lotz, Wetter; Heinrich Stevermuer, Bochum, both of Fed. Rep. of Germany

[73] Assignee: M.A.N. Maschinenfabrik Augsburg-Nürnberg Aktiengesellschaft, Fed. Rep. of Germany

[21] Appl. No.: 753,914

[22] Filed: Jul. 11, 1985

[30] Foreign Application Priority Data

Aug. 29, 1984 [DE] Fed. Rep. of Germany ..... 3431653

[51] Int. Cl.[4] ..... B03B 11/00

[52] U.S. Cl. ..... 209/496; 209/490

[58] Field of Search ..... 209/490, 491, 495, 496

[56] References Cited

U.S. PATENT DOCUMENTS

| | | | |
|---|---|---|---|
| 963,519 | 7/1910 | Cory | 209/496 |
| 965,294 | 7/1910 | Hancock | 209/495 |
| 1,931,390 | 10/1933 | Norton | 209/496 |
| 2,819,797 | 1/1958 | Woodhead | 209/496 |

FOREIGN PATENT DOCUMENTS

| | | | |
|---|---|---|---|
| 588699 | 4/1933 | Fed. Rep. of Germany | 209/496 |
| 1090151 | 10/1960 | Fed. Rep. of Germany | 209/491 |
| 1122011 | 1/1962 | Fed. Rep. of Germany | 209/491 |
| 1123631 | 4/1965 | Fed. Rep. of Germany . | |

*Primary Examiner*—Andres Kashnikow
*Assistant Examiner*—Michael J. Forman
*Attorney, Agent, or Firm*—McGlew and Tuttle

[57] ABSTRACT

In a discharge device for heavy matter discharge in settling machines for the processing of coal or other mineral raw materials by means of a bottom drain with variable opening cross-section actuated by a device for sensing the heavy matter layer, at least two bottom drains arranged one behind the other in flow direction are actuated simultaneously by a single sensing device.

5 Claims, 2 Drawing Figures

COAL PROCESSING SETTLING MACHINE

FIELD AND BACKGROUND OF THE INVENTION

This invention relates in general to coal processing devices and in particular to a new and useful discharge device for fluids containing heavy matter which includes a valve regulating discharge at separate flow levels in a flow stream through a vessel to a collecting bottom which includes means for sensing the level of the solids and for actuating the drain valves in the various levels accordingly.

The invention relates particularly to a discharge device for the discharge of heavy matter in settling machines for the processing of coal or other mineral raw materials by means of a bottom drain of variable opening cross section actuated by a device for sensing the heavy matter layer.

In settling machines for the processing of coal or other mineral raw materials, the heavy matter is often discharged by means of a bottom drain. The opening of the bottom drain is regulated in that the heavy matter bed is sensed by a float and a change in the height of the heavy matter bed brings about an adjustable change of the discharge opening.

To keep the volume of the heavy matter bed to be discharged constant, the drain must always draw off as much material as new heavy matter is supplied with the material being charged. For reasons of process engineering it is necessary that the geometry in the region of the drain be selected so that a reserve layer forms above the drain, having a layer thickness greater than in the forward region of the settling material support.

With the known discharge regulating systems it is indeed possible to act on the adjustment of the discharge as a function of the change in bed position and to make it relatively sensitive; but as the quantity of heavy matter to be discharged, increases the more difficult it becomes to discharge the heavy matter neatly.

Because of the large amount of waste to be discharged per unit time and because of the electrical and mechanical delay in the discharge control system, it may happen that not only heavy matter but also lighter matter is drawn into the drain. This is due to the fact that when larger amounts of heavy matter are being drawn off, a suction funnel, as it were, forms above the drain, since in the known drains the discharge occurs through a relatively narrow gap, i.e. practically in punctiform manner.

SUMMARY OF THE INVENTION

The invention provides a settling device which lets the discharge of the heavy matter occur over a larger area, so as to avoid the described funnel formation, and thus to get to a uniform draw-off of the heavy matter and hence to avoid deficient discharges.

According to the invention, a single sensing device is used to control the actuation of at least two bottom drains arranged one behind the other in flow direction so that they are actuated simultaneously.

The known bottom drain, therefore, is preceded e.g. by an additional drain, thus practically doubling the area over which discharge takes place. The sensing of the heavy matter bed occurs further through only one float, arranged over the second drain, seen in the flow direction. Through the discharge control both the second and the first discharge openings are adjusted in such a way that the first drain is connected with the second drain by way of the extension rod, and through an appropriate lever arrangement it is possible, according to the invention, to let the adjustment of the opening cross-section of the bottom drains take place either in the same proportion or in a different proportion to each other.

The distance between the first and second drains and the arrangement of the two drains relative to each other are selected so that formation of the heavy matter bed between the two drains is not disturbed and a uniform sinking of the separating layer between heavy and light matter occurs uniformly over the region of the two drains.

In further development of the idea of the invention, at least one bottom drain may be arranged entirely in the settling bed portion without settling lumps; e.g. feldspar grain. The discharge chute of the additional discharge is arranged in the settling bed portion with settling lumps; e.g. feldspar grain and in such a way that the front edge of this discharge chute ends with the transverse wall between the settling chamber without lumps and the settling chamber with lumps.

Accordingly, it is an object of the invention to provide an improved device for the discharge of materials containing heavy solids which includes a vessel having drain levels each with a separate drain valve and with means for sensing the level of the solids adjacent the drain valve and for operating the drain valve in accordance with the sensed level.

A further object of the invention is to provide a device for controlling the settling of heavy matter which is simple in design, rugged in construction and economical to manufacture. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter of which a preferred embodiment of the invention is illustrated.

DESCRIPTION OF THE PREFERRED EMBODIMENT

Figure 1:
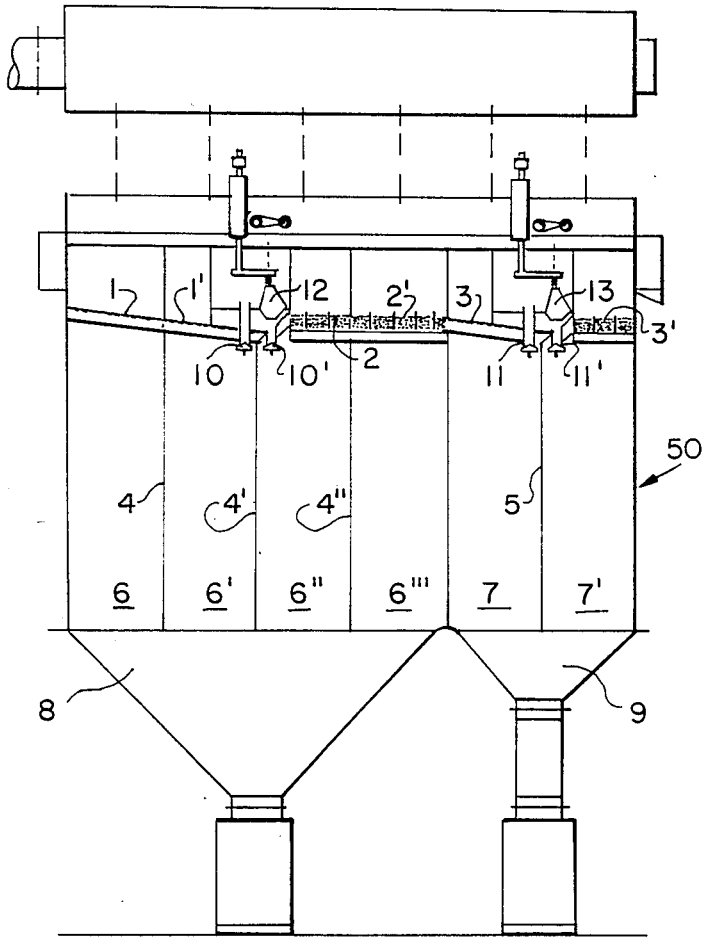
FIG. 1 is a longitudinal sectional view through a settling machine constructed in accordance with the invention.

Referring to the drawings in particular the invention embodied therein comprises a discharge for the discharge of fluids containing heavy matter which includes a vessel generally designated 50 which has a plurality of transverse walls 4, 4', 4'' dividing an upstream flow portion of the vessel into a plurality of settling areas 6,6', 6'' and 6''', which empty into a bottom vat 8. Another transverse wall 5 divides separate compartment portions of the vessel serving a distinct drain level which empties into a bottom vat 9. The device of the invention is particularly useful for the processing of coal into which fluid containing heavy matter is directed into the top of the vessel 50 and exits downwardly through the compartments 6,6',6'',6''' and 7, 7' before going to a vat 8 or 9 leading to a bottom discharge. The interior of the vessel 50 has a plurality of settling bed walls 1,1',2,2' and 3,3' with at least some of them having distinct or separate drain levels arranged in the flow stream from the top inlet to the bottom discharge. Some of the drain levels have separate drains 10, 10' and 11, 11' each of which contains a valve member 11*a*, 11*a'* which is connected to a linkage system which is part of drive means including a fluid piston cylinder 22. Sensor means in the form of a float 13 are employed to sense the level of the solids 2',3' and they are connected to a control 20 which operates the drive 15,22 to effect the change in the position of the valves relative to the valve chute or discharge opening 18,18'. Variations of the movement of the valves 11*a* and 11*a'* may be effected by the placement of of an extension linkage 14 in respect to a connecting linkage 16 which interconnects the two valve members.

The product settling machine illustrated in FIG. 1 with a bottom drain for middlings and waste and with a coal overflow, has six successive settling bed portions 1,1',2,2',3,3'. Under the settling bed portions 1,1',2,2' is the bottom vat 8, separated into four compartments 6,6',6'',6''' by the transverse walls 4,4',4''. Under the settling bed portions 3,3' is the bottom vat 9 separated into two compartments 7,7' by the transverse wall 5.

Compartment 6,6',6'',6''', 7 and 7' extend one after the other in the flow direction of incoming material across the top of vessel 50.

The settling bed portions 2,2',3' are covered with settling lumps, e.g. feldspar grain.

That is heavier parts of the incoming fluid settle onto the beds.

A first bottom drain assembly 10 for middlings is completely within the settling bed portion 1' without settling lumps, while the discharge chute of an additional bottom drain assembly 10' for middlings is arranged in the settling bed portion 2 with settling lumps in such a way that the front edge of this discharge chute ends with the transverse wall 4' between the settling chamber without settling lumps and the settling chamber with settling lumps.

Bottom drain assemblies 11 and 11' for waste are analogously arrange in the settling bed portions 3 and 3'.

Above the bottom drain assembly 10' of the middlings discharge and above the bottom drain assembly 11' of the waste discharge, floats 12 and 13 are arranged.

Figure 2:
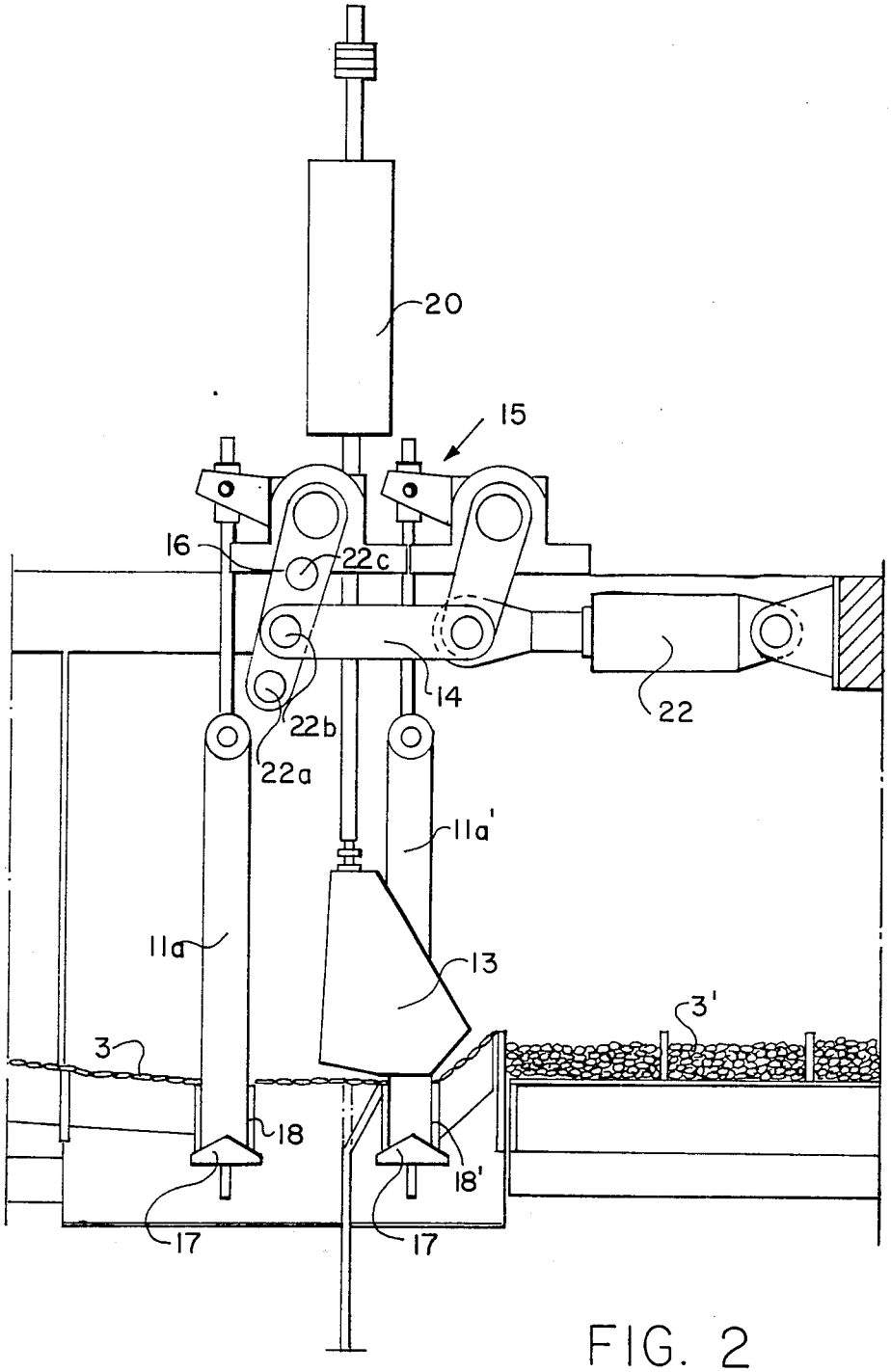
FIG. 2 is an enlarged longitudinal section of the discharge device shown in FIG. 1.

Above the floats, FIGS. 1 and 2 show schematically a discharge regulating switch or sensing and control device 20 which, as is known, operates so that the float acts as a sensing element and senses the layer thickness on the settling bed and transmits it to a discharge regulating switch of the control 20. In the discharge regulating switch of the control 20 two contactless limit switches are arranged, whose distance from each other is greater than the settling stroke, which means that the normal pulsation of the float due to the settling stroke can be neglected in the discharge regulating switch. If the thickness of the reserve layer increases and hence the position of the float rises, and a float flag thereon closes the upper contact. The discharge regulating switch actuates directly without intermediate member a solenoid valve in the hydraulic station and the bottom drain is opened. Termination of the opening process occurs via the return motion. The completed displacement of the bottom drain is transmitted via a lever linkage 15 to the discharge regulating switch control 20 whose regulating behavior is proportional.

The discharge device including a piston cylinder driver 22 is shown on a larger scale in FIG. 2 of bottom drives 10, 10', 11, 11' of the right-hand part of FIG. 1.

The bottom discharge driver assembly 11' is connected via a linkage connecting member 14 with the preceding bottom discharge drain assembly 11' is connected via a linkage connecting member 14 with the preceding bottom discharge drain assembly 11.

The sensing of the heavy matter layer occurs by the one and only float 13, which is arranged above the discharge of the bottom discharge drain assembly 11'. With a known regulating system (not shown in detail, the opening of the bottom discharge drain assembly 11 as well as of the bottom discharge drain assembly 11' is adjusted, this being done with the lever arrangement marked 15.

FIG. 2 shows further that the adjustment of the opening cross-section of the bottom drains of the bottom discharge assemblies 11 and 11' takes place in the same proportion, as the connecting member 14 is articulated to a central hole 22*b* of a crank or lever 16 having correcting holes 22*a*, 22*b*, and 22*c*. By changing the hinge point of the member 14 at the lever 16, a different opening cross section of the bottom drain 11 relative to the bottom drain 11' can be obtained.

According to FIG. 2, both openings of the bottom drain assemblies 11 and 11' are closed, as the saddle-shaped closure plates 17 and 17' apply against the discharge chutes 18 and 18'. Instead of saddle-shaped closure plates, plates sloping to one side may be used.

Instead of a unilateral hydraulic actuation by the driver 22 of the extension rod 14, as illustrated in FIG. 2, the actuation can occur for example with a double-action cylinder operating from left to ring (not shown) or in other known ways.

Naturally, instead of the sensing and regulating system described and illustrated, an inductive or any other sensing and regulating method of the state of the art may be used.

While a specific embodiment of the invention has been shown and described in detail to illustrate the application of the principles of the invention, it will be understood that the invention may be embodied otherwise without departing from such principles.

What is claimed is:

1. A discharge device for the discharge of heavy matter from a fluid containing the heavy matter in a settling machine for the processing of coal and the like, comprising a vessel defining an interior having an upper portion with a plurality of settling bed wall portions, said vessel having an upper inflow opening for the inflow of fluid and for the passage of fluid in a flow direction along said settling bed wall portions, two discharge openings at the bottom of each settling bed wall portion, said two discharge openings for each settling bed wall portion being spaced apart in the flow direction, a valve member movable in each of said discharge openings for opening and closing each discharge opening for permitting the passage of heavy matter which has settled onto said settling bed wall portion to pass through said discharge opening, a control device connected to said valve members for moving said valve members to open and close said discharge openings for each settling bed wall portion, and a level-sensing element for each settling bed wall portion positioned above the downstream one of said discharge openings in said flow direction for each settling bed wall portion, for sensing the level of fluid in said upper portion of said vessel above said downstream one of said discharge openings for each settling bed wall portion, said level-sensing element being connected to said control device for each settling bed wall portion, for simultaneously moving said valve members to open both of said discharge openings for each settling bed wall portion.

2. A discharge device according to claim 1 wherein said control device includes an actuator and linkage means connected between said actuator and said valve members for moving said valve members for each settling bed wall portion.

3. A discharge device according to claim 2 wherein said linkage means moves each of said valve members for each settling bed wall portion by equal amounts.

4. A discharge device according to claim 2 wherein said linkage means moves said valve members by different amounts for each settling bed wall portion.

5. A discharge device according to claim 1 wherein said interior of said vessel includes a lower portion, a plurality of dividing walls in said lower portion dividing said lower portion into a plurality of compartments spaced along the flow direction, one of said dividing walls being between said two discharge openings of each settling bed wall portion.

* * * * *